US010591169B2

(12) United States Patent
Hanazono et al.

(10) Patent No.: US 10,591,169 B2
(45) Date of Patent: Mar. 17, 2020

(54) SIGNAL PROCESSING DEVICE, SIGNAL PROCESSING METHOD, PROGRAM, AND RANGEHOOD APPARATUS

(71) Applicant: Panasonic Intellectual Property Management Co., Ltd., Osaka (JP)

(72) Inventors: Masaya Hanazono, Osaka (JP); Wakio Yamada, Hyogo (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 15/570,877

(22) PCT Filed: Apr. 25, 2016

(86) PCT No.: PCT/JP2016/002166
§ 371 (c)(1),
(2) Date: Oct. 31, 2017

(87) PCT Pub. No.: WO2016/178309
PCT Pub. Date: Nov. 10, 2016

(65) Prior Publication Data

US 2018/0135864 A1 May 17, 2018

(30) Foreign Application Priority Data

May 7, 2015 (JP) ..... 2015-094987

(51) Int. Cl.
*F24C 15/20* (2006.01)
*G10K 11/178* (2006.01)
(Continued)

(52) U.S. Cl.
CPC ..... *F24C 15/2042* (2013.01); *F24C 15/2021* (2013.01); *F24C 15/2035* (2013.01);
(Continued)

(58) Field of Classification Search
CPC ..... F24F 13/24; F24F 2013/247; F24F 7/06; F24F 2130/40; F24C 15/2042;
(Continued)

(56) References Cited

U.S. PATENT DOCUMENTS 5,426,703 A 6/1995 Hamabe et al.
5,511,129 A * 4/1996 Craven ..... H03G 5/165 381/103
2015/0003625 A1* 1/2015 Uhle ..... H04R 3/002 381/71.6

FOREIGN PATENT DOCUMENTS

JP H07-074590 A 3/1995
JP 07248784 9/1995
(Continued)

OTHER PUBLICATIONS

International Search Report and Written Opinion for International Application No. PCT/JP2016/002166, dated Jul. 12, 2016.

*Primary Examiner* — Vivian C Chin
*Assistant Examiner* — Douglas J Suthers
(74) *Attorney, Agent, or Firm* — Renner, Otto, Boisselle & Sklar, LLP

(57) ABSTRACT

In a signal processing device, a signal processing method, a recording medium, and a rangehood apparatus, a filter coefficient is set in a sound cancelling filter, and the sound cancelling filter outputs a cancellation signal. A coefficient calculator calculates a first filter coefficient. An oscillation suppressor calculates a second filter coefficient by applying a window function to the first filter coefficient to set the second filter coefficient as the filter coefficient.

12 Claims, 8 Drawing Sheets

(51) Int. Cl.

| | |
|---|---|
| ***H04R 1/02*** | (2006.01) |
| *F24F 7/06* | (2006.01) |
| *F24F 130/40* | (2018.01) |
| *F24F 13/24* | (2006.01) |

(52) U.S. Cl.
CPC .. *G10K 11/17823* (2018.01); *G10K 11/17833* (2018.01); *G10K 11/17853* (2018.01); *G10K 11/17854* (2018.01); *G10K 11/17881* (2018.01); *H04R 1/028* (2013.01); *F24F 7/06* (2013.01); *F24F 2013/247* (2013.01); *F24F 2130/40* (2018.01); *G10K 2210/105* (2013.01); *G10K 2210/3028* (2013.01); *G10K 2210/3045* (2013.01); *G10K 2210/503* (2013.01)

(58) Field of Classification Search
CPC ..... F24C 15/2035; F24C 15/2021; G10K 11/178; G10K 11/1782; G10K 2210/105; G10K 2210/3028; G10K 11/17853; G10K 11/17833; G10K 11/17881; G10K 11/17854; G10K 11/17823; H04R 1/028
USPC ..... 381/71.3, 71.11, 71.12
See application file for complete search history.

(56) References Cited

FOREIGN PATENT DOCUMENTS

| | | | |
|---|---|---|---|
| JP | H08-129388 | A | 5/1996 |
| JP | H10-171466 | A | 6/1998 |
| JP | 3094517 | | 10/2000 |
| JP | 4350917 | B2 | 10/2009 |
| JP | 2014-077906 | A | 5/2014 |
| JP | 5646806 | B2 | 12/2014 |

* cited by examiner

SIGNAL PROCESSING DEVICE, SIGNAL PROCESSING METHOD, PROGRAM, AND RANGEHOOD APPARATUS

TECHNICAL FIELD

The present invention relates to a signal processing device, a signal processing method, a program, and a rangehood apparatus.

BACKGROUND ART

A known active noise control device involves active noise control as a technique for reducing noise in a target space (noise propagation passage) in which a sound generated from a noise source propagates. The active noise control is a technique for actively reducing noise by outputting a cancelling sound having an antiphase to the phase of the noise and having an amplitude identical with the amplitude of the noise.

Such an active noise control device has a problem that reflection of the sound propagating in the target space degrades the noise cancellation performance of the active noise control device. To solve this problem, it has been proposed to multiply a filter coefficient by a window function so as to suppress degradation in the noise cancellation performance due to a reflection wave (for example, see Patent Literatures 1 to 3).

In the active noise control device, a change of environmental conditions such as the temperature, humidity, and atmospheric pressure in the target space and/or a disturbance component such as an intruding extraneous sound may cause oscillation and/or divergence leading to the degradation in the noise cancellation performance. However, the above-described Patent Literatures 1 to 3 are directed to suppress the degradation in the noise cancellation performance due to the reflection of the sound propagating in the target space, and therefore, it has been difficult to suppress the degradation in the noise cancellation performance due to the disturbance component.

CITATION LIST

Patent Literature

Patent Literature 1: JP H07-74590 A
Patent Literature 2: JP 4350917 B2
Patent Literature 3: JP 5646806 B2

SUMMARY OF INVENTION

One of the objectives of the present invention is to provide a signal processing device, a signal processing method, a program, and a rangehood apparatus which reduce oscillation caused by a change of environmental conditions such as the temperature, humidity, and atmospheric pressure in a target space and/or a disturbance component such as an intruding extraneous sound to suppress degradation in a noise cancellation performance.

A signal processing device according to an aspect of the present invention includes a sound cancelling filter, a coefficient calculator, and an oscillation suppressor. The signal processing device is to be used in combination with a sound input/output device. The sound input/output device includes a first sound input device, a sound output device, and a second sound input device. The first sound input device is disposed in a target space in which noise generated from a noise source propagates. The first sound input device is configured to collect the noise. The sound output device is configured to receive a cancellation signal to output a cancelling sound for cancelling the noise to the target space. The second sound input device is configured to collect a synthetic sound of the noise and the cancelling sound in the target space. A filter coefficient is set in the sound cancelling filter. The sound cancelling filter is configured to output the cancellation signal based on an output of the first sound input device. The coefficient calculator is configured to calculate a first filter coefficient based on the output of the first sound input device and an output of the second sound input device. The oscillation suppressor is configured to calculate a second filter coefficient by applying a window function for suppressing oscillation to the first filter coefficient and to set the second filter coefficient as the filter coefficient of the sound cancelling filter.

A signal processing method according to an aspect of the present invention is a signal processing method used in a signal processing device which is to be combined with a sound input/output device. The sound input/output device includes a first sound input device disposed in a target space in which noise generated from a noise source propagates, a sound output device, and a second sound input device. The first sound input device is configured to collect the noise. The sound output device is configured to receive a cancellation signal to output a cancelling sound for cancelling the noise to the target space. The second sound input device is configured to collect a synthetic sound of the noise and the cancelling sound in the target space. The signal processing method includes: outputting the cancellation signal from a sound cancelling filter in which a filter coefficient is set, the cancellation signal being based on an output of the first sound input device; calculating a first filter coefficient by a coefficient calculator based on an output of the first sound input device and an output of the second sound input device; and calculating a second filter coefficient by applying a window function for suppressing oscillation to the first filter coefficient by an oscillation suppressor to set the second filter coefficient as the filter coefficient of the sound cancelling filter.

A program according to an aspect of the present invention causes a computer to function as the above-described signal processing device.

A rangehood apparatus according to an aspect of the present invention includes the above-described signal processing device, the sound input/output device, an air passage having a hollow cylindrical shape and included in the target space, and an air blowing device configured to generate airflow from one end toward the other end of the air passage.

DESCRIPTION OF EMBODIMENTS

With reference to the drawings, embodiments of the present invention will be described below.

The embodiments below generally relates to a signal processing device, a signal processing method, a program, and a rangehood apparatus. More specifically, the embodiment relates to a signal processing device, a signal processing method, a program, and a rangehood apparatus which use active noise control.

First Embodiment

Figure 1:
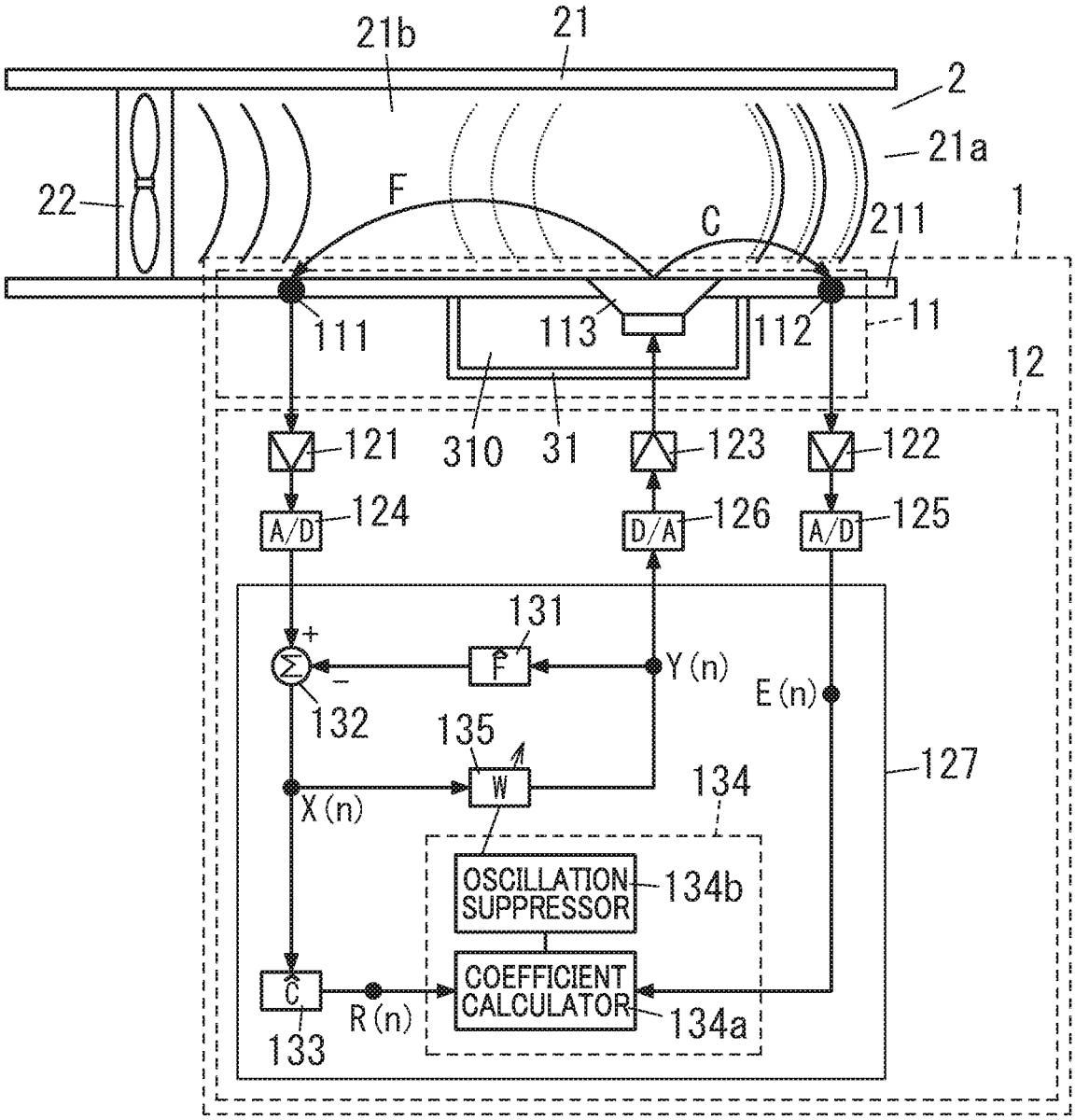
FIG. 1 is a block diagram illustrating a configuration of a rangehood apparatus of a first embodiment.

FIG. 1 shows a configuration of a noise cancelling device 1 (active noise control device) of the present embodiment, wherein a rangehood apparatus 2 includes the noise cancelling device 1.

Figure 2:
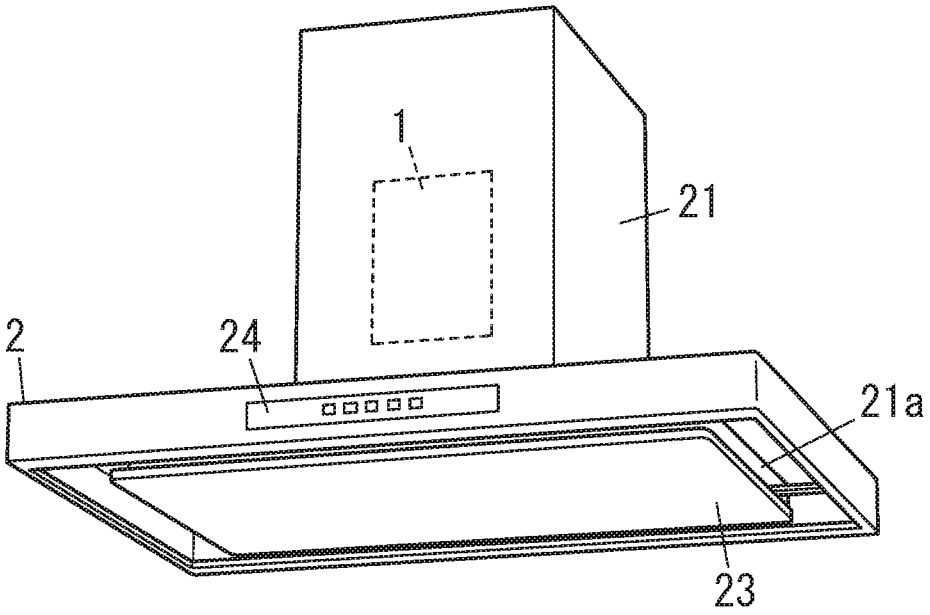
FIG. 2 is a perspective view illustrating an exterior of the rangehood apparatus of the first embodiment.

As illustrated in FIG. 2, the rangehood apparatus 2 includes a duct 21 (air passage) disposed above kitchen appliances in a kitchen room. The duct 21 has a box shape whose lower surface is provided with an inlet 21*a*. The duct 21 accommodates a fan 22 (see FIG. 1). The fan 22 sucks indoor air into the duct 21 via the inlet 21*a* to release the indoor air outdoors. The inlet 21*a* is provided with a straightening plate 23. The straightening plate 23 is slightly smaller than the inlet 21*a* and improves the air intake efficiency. The rangehood apparatus 2 has a front surface provided with an operation section 24. The operation section 24 includes operation switches each for one of operation patterns of the rangehood apparatus 2, and an indicator for indicating operational states. In the duct 21, a space forming an air passage corresponds to a target space in which noise propagates.

When the fan 22 (air blowing device) operates, the fan 22 serves as a noise source, and an operational sound (noise) of the fan 22 propagates in the duct 21 and is transmitted from the inlet 21*a* to the room. In order to reduce the noise transmitted to the room during the operation of the fan 22, the duct 21 is provided with the noise cancelling device 1.

As illustrated in FIG. 1, the noise cancelling device 1 installed in the duct 21 includes a sound input/output device 11 and a signal processing device 12.

The sound input/output device 11 includes a reference microphone 111 (first sound input device), an error microphone 112 (second sound input device), and a loudspeaker 113 (sound output device). The reference microphone 111 is located adjacently to the fan 22 in the duct 21. The error microphone 112 is located adjacently to the inlet 21*a* in the duct 21. The loudspeaker 113 is located between the reference microphone 111 and the error microphone 112 in the duct 21. That is, in the space, the reference microphone 111, the loudspeaker 113, and the error microphone 112 are arranged in this order from the fan 22 to the inlet 21*a*.

The signal processing device 12 includes amplifiers 121, 122, and 123, A/D converters 124 and 125, a D/A converter 126, and a noise cancellation control block 127.

An output of the reference microphone 111 is amplified in the amplifier 121 and is then subjected to A/D conversion in the A/D converter 124. An output of the A/D converter 124 is input to the noise cancellation control block 127.

An output of the error microphone 112 is amplified in the amplifier 122 and is then subjected to A/D conversion in the A/D converter 125. An output of the A/D converter 125 is input to the noise cancellation control block 127.

A cancellation signal output from the noise cancellation control block 127 is subjected to D/A conversion in the D/A converter 126 and is then amplified in the amplifier 123. The loudspeaker 113 receives the cancellation signal amplified in the amplifier 123 to output a cancelling sound.

The noise cancellation control block 127 includes a computer configured to execute a program. In order to minimize a sound pressure level at an installation point (noise cancellation point) of the error microphone 112, the noise cancellation control block 127 causes the loudspeaker 113 to output the cancelling sound for cancelling the noise generated from the fan 22. That is, the loudspeaker 113 outputs the cancelling sound, thereby reducing the noise to be transmitted from the fan 22 through the inlet 21*a* to the outside of the duct 21. The noise cancellation control block 127 performs active noise control. In order to follow a noise change of the fan 22 serving as the noise source and a change in noise propagation characteristic, the noise cancellation control block 127 executes a noise cancellation program which provides a function of an adaptive filter. To update the filter coefficient of the adaptive filter, a filtered-X Least Mean Square (LMS) sequential update control algorithm is used.

Operation of the signal processing device 12 will be described below.

First, the reference microphone 111 collects noise from the fan 22 and outputs a noise signal including the collected noise to the signal processing device 12. The A/D converter 124 performs A/D conversion of the noise signal, which has been amplified in the amplifier 121, at a predetermined sampling frequency to obtain a discrete value. The A/D converter 124 outputs the discrete value to the noise cancellation control block 127.

The error microphone 112 collects residual noise which has not been cancelled by the cancelling sound at the noise cancellation point, and the error microphone 112 outputs an error signal corresponding to the collected residual noise to the signal processing device 12. The A/D converter 125 performs A/D conversion of the error signal, which has been amplified in the amplifier 122, at the same sampling frequency as the sampling frequency of the A/D converter 124 to obtain a discrete value. The A/D converter 125 outputs the discrete value as an error signal E(n) in a time domain to the noise cancellation control block 127. The error signal E(n) is input to a coefficient updating unit 134 of the noise cancellation control block 127. Note that n is a sample number after the A/D conversion.

The noise cancellation control block 127 includes a howling cancel filter 131, a subtractor 132, a correction filter 133, the coefficient updating unit 134, and a sound cancelling filter 135.

The howling cancel filter 131 is a Finite Impulse Response (FIR) Filter. In the howling cancel filter 131, a transfer characteristic $\hat{F}$ simulating a transfer characteristic F of a sound wave from the loudspeaker 113 to the reference microphone 111 is set as a filter coefficient. Note that the transfer characteristic simulating the transfer characteristic F is denoted by the symbol F^ which is a symbol F provided with a chevron symbol ^ (hat symbol). In this specification, the symbol ^ is arranged obliquely above F, and in FIGS. 1, 6, 7, and 9, the symbol ^ is arranged directly above F, but in both cases, F provided with the symbol ^ represents a transfer characteristic simulating the transfer characteristic F.

The howling cancel filter 131 performs convolution of the transfer characteristic F^ on a cancellation signal Y(n) output from the sound cancelling filter 135. Then, the subtractor 132 outputs a signal obtained by subtracting an output of the howling cancel filter 131 from the output of the A/D converter 124. That is, a signal obtained by subtracting a wraparound component of the cancelling sound from the noise signal collected by the reference microphone 111 is output as a noise signal X(n) in the time domain from the subtractor 132. Therefore, even if the cancelling sound output from the loudspeaker 113 wraps around the reference microphone 111, the occurrence of howling can be prevented. The output of the subtractor 132 is input to the sound cancelling filter 135 and the correction filter 133.

The sound cancelling filter 135 is a FIR adaptive filter, and a filter coefficient W is set in the sound cancelling filter 135.

The correction filter 133 is a FIR filter. In the correction filter 133, a transfer characteristic C^ is set as a filter coefficient. The transfer characteristic C^ simulates a transfer characteristic C of a sound wave which reaches the error microphone 112 from the loudspeaker 113. The correction filter 133 performs convolution of the noise signal X(n) output from the subtractor 132 and the transfer characteristic C^. An output of the correction filter 133 is input as a reference signal R(n) in the time domain to the coefficient updating unit 134. Note that the transfer characteristic simulating the transfer characteristic C is denoted by the symbol C^ which is a symbol C provided with a chevron symbol ^. In this specification, the symbol ^ is arranged obliquely above C, and in FIGS. 1, 6, 7, and 9, the symbol ^ is arranged directly above C, but in both cases, C provided with the symbol ^ represents a transfer characteristic simulating the transfer characteristic C.

The coefficient updating unit 134 includes a coefficient calculator 134*a* and an oscillation suppressor 134*b*.

The coefficient calculator 134*a* calculates by using a known sequential update control algorithm, filtered-X LMS, in the time domain to calculate a filter coefficient W1(*n*) (first filter coefficient). This coefficient calculator 134*a* receives the reference signal R(n) and the error signal E(n) to compute the filter coefficient W1(*n*).

In general, in arithmetic processing of the filter coefficient W1(*n*) using the filtered-X LMS, the filter coefficient W1(*n*) is calculated such that the error signal E(n) is minimum. Specifically, when the update parameter is denoted by μ, and the sample number is denoted by n, the arithmetic processing of the filter coefficient W1(*n*) is expressed as Formula 1. Note that the update parameter μ is also referred to as a step size parameter. The update parameter μ is a parameter for determining the magnitude of the correction amount of each filter coefficient W1(*n*) in a process for repeatedly calculating the filter coefficient W1(*n*) by using, for example, the LMS algorithm.

$$W1(n+1)=W1(n)-2\mu R(n)E(n) \quad \text{[Formula 1]}$$

Figure 3:
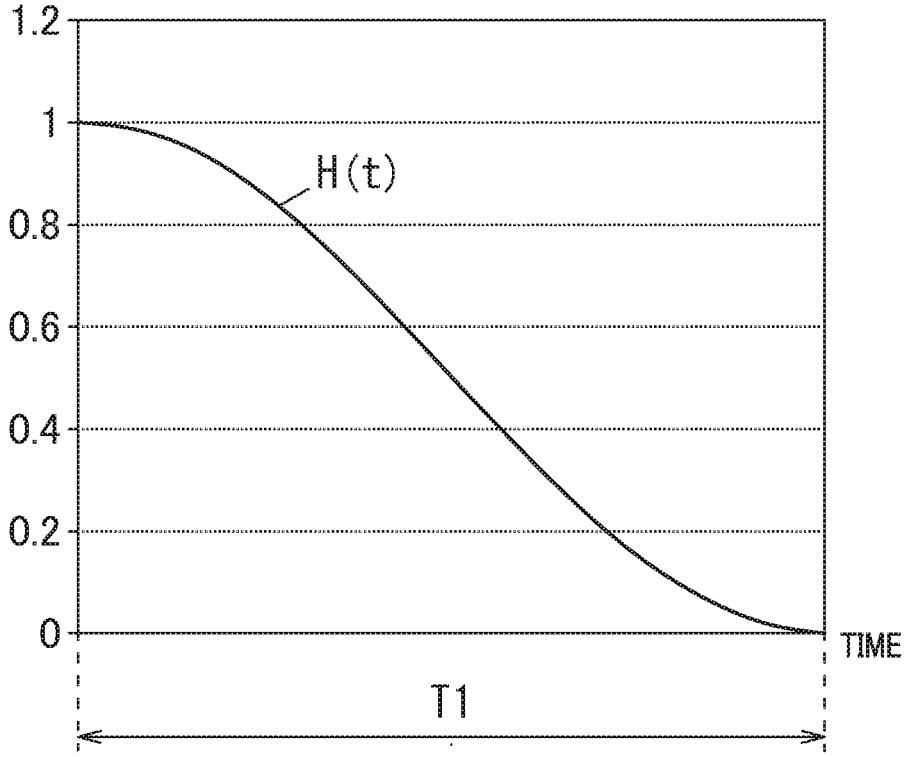
FIG. 3 is a graph illustrating a window function of the first embodiment.

Each time the coefficient calculator 134*a* calculates the filter coefficient W1(*n*), the oscillation suppressor 134*b* multiplies the filter coefficient W1(*n*) by a window function H(n) shown in FIG. 3. The window function H(n) is expressed as Formula 2, where the sound cancelling filter 135 has a tap length of N and a sample number of n (0≤n≤N). The function value of the window function H(n) is "1" when the sample number n=0, and as time passes, the function value gradually decreases and reaches "0" when the sample number n=N. That is, the window function H(n) is a function which converges with a lapse of time. Note that in FIG. 3, the time length of the window function H(n) is denoted by T1, and the time length T1 corresponds to the tap length N. The window function H(n) shown in FIG. 3 is also referred to as a division Hanning window.

$$H(n) = 0.5 - 0.5\cos\left\{\frac{(n-N)\pi}{N}\right\} \quad \text{[Formula 2]}$$

The oscillation suppressor 134*b* multiplies the filter coefficient W1(*n*) by the window function H(n) to determine a filter coefficient W2(*n*) (second filter coefficient). The gain of the filter coefficient W2(*n*) is less than or equal to the gain of the filter coefficient W1(*n*) calculated by the coefficient calculator 134*a*, and as time passes, the difference between the gain of the filter coefficient W2(*n*) and the gain of the filter coefficient W1(*n*) becomes large. The oscillation suppressor 134*b* sets the filter coefficient W2(*n*) as the filter coefficient W of the sound cancelling filter 135 (filter coefficient W=W2(*n*)) to update the filter coefficient W of the sound cancelling filter 135. That is, a process of multiplication by the window function H(n) is repeated each time the filter coefficient W is updated, and the gain of the filter coefficient W(=W2(*n*)) decreases as time passes after the update.

The sound cancelling filter 135 performs convolution of the noise signal X(n) and the filter coefficient W(=W2(*n*)). Then, the sound cancelling filter 135 outputs a result of the convolution as a cancellation signal Y(n). The cancellation signal Y(n) is subjected to D/A conversion in the D/A converter 126 and is then amplified in the amplifier 123 to output a cancelling sound from the loudspeaker 113.

With reference to FIGS. 4A, 4B, 5A, and 5B, description will hereinafter be given to specific effects of the present embodiment.

First, with reference to FIGS. 4A and 4B, description will be given to a case where the oscillation suppressor 134*b* of the present embodiment does not execute the process (window function process) of multiplication by the window function H(n), and the filter coefficient W1(*n*) is set as the filter coefficient W of the sound cancelling filter 135 (filter coefficient W=W1(*n*)).

Figure 4A:
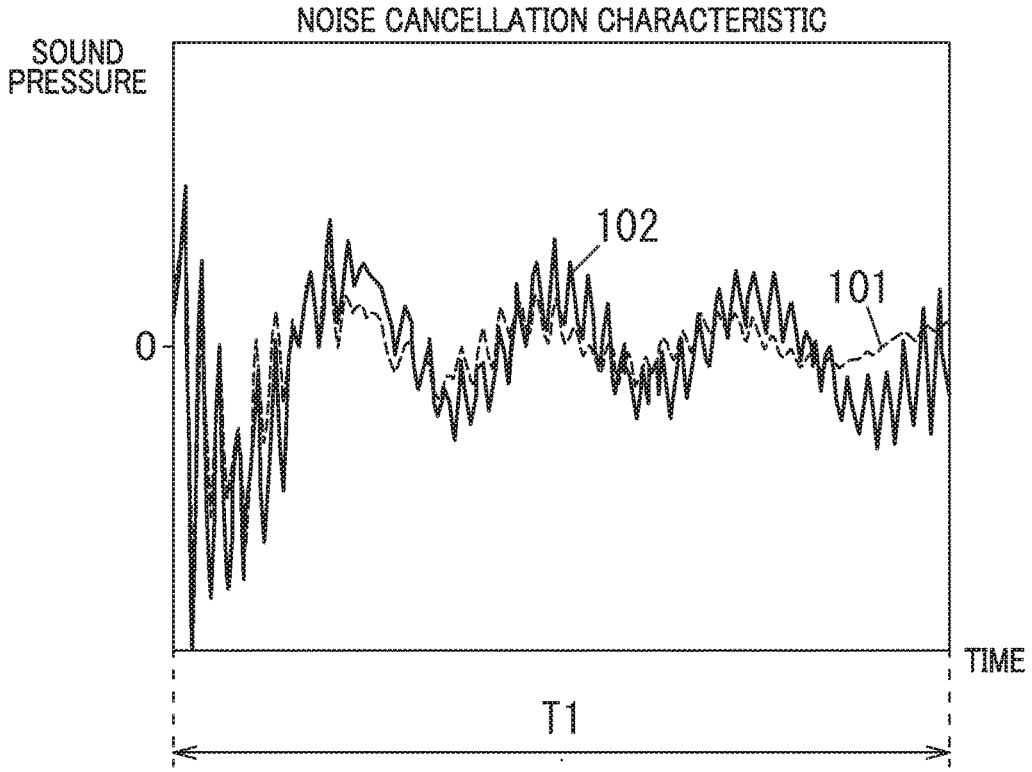
FIG. 4A is an explanatory view illustrating a time variation of a filter coefficient when a window function process is not executed.

FIG. 4A shows a noise cancellation characteristic (for example, an error signal output from the error microphone 112) in the time domain over the time length T1 of the window function without the window function process being executed. In FIG. 4A, the broken line 101 shows a noise cancellation characteristic with stabilization control being performed. On the other hand, the solid line 102 shows a noise cancellation characteristic at the time of oscillation, and the oscillation width of an error signal is large. That is, when the stabilization control is performed without the window function process being executed, the error signal tends to converge. However, in the case of oscillation without the window function process being executed, the convergence tendency of the error signal is low, and a noise cancellation performance at the time of the oscillation is degraded. Note that in FIG. 4A, the time length of the window function H(n) is denoted by T1, and the time length T1 corresponds to the tap length N.

Figure 4B:
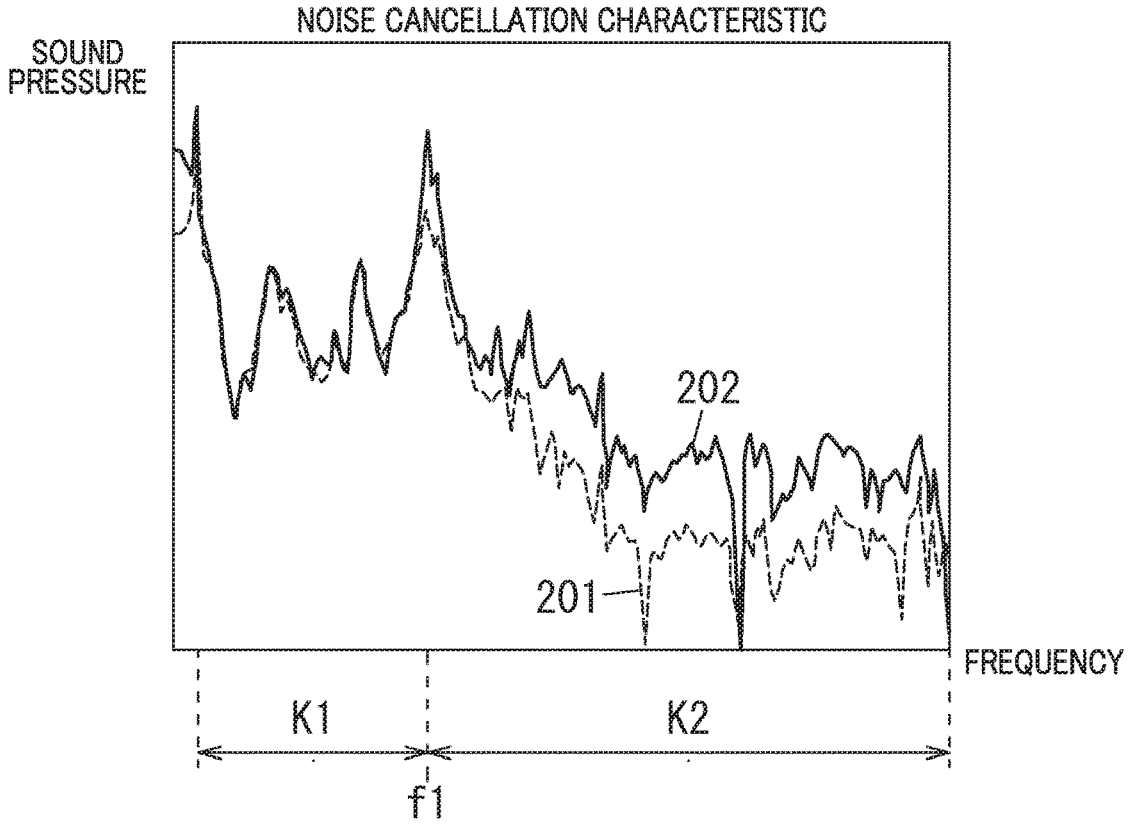
FIG. 4B is a waveform diagram illustrating a noise cancellation characteristic when the window function process is not executed.

Moreover, FIG. 4B shows a noise cancellation characteristic in the frequency domain without the window function process being executed. In FIG. 4B, the broken line 201 corresponds to a noise cancellation characteristic with the stabilization control being performed with the filter coefficient W=W1(*n*). In contrast, the solid line 202 corresponds to a noise cancellation characteristic when oscillation occurs with the filter coefficient W=W1(*n*). The sound pressure at the time of the oscillation is higher than that in the case of the stabilization control being performed, and the noise cancellation performance at the time of the oscillation is degraded. Specifically, in a target band K1 which is to be a noise cancellation target, the sound pressure at the frequency f1 is high at the time of the oscillation. Moreover, also in a non-target band K2 which is a higher frequency band than the target band K1 and which is deviated from the noise cancellation target, the sound pressure is high at the time of the oscillation.

As described above, when the window function process is not executed, a change of environmental conditions such as the temperature, humidity, and atmospheric pressure in the space in the duct 21 and/or a disturbance component such as an intruding extraneous sound may cause oscillation, and the oscillation degrades the noise cancellation performance.

Next, with reference to FIGS. 5A and 5B, description will be given to a case where the window function process is executed, and the filter coefficient W2(*n*) is set as the filter coefficient W of the sound cancelling filter 135 (filter coefficient W=W2(*n*)).

Figure 5A:
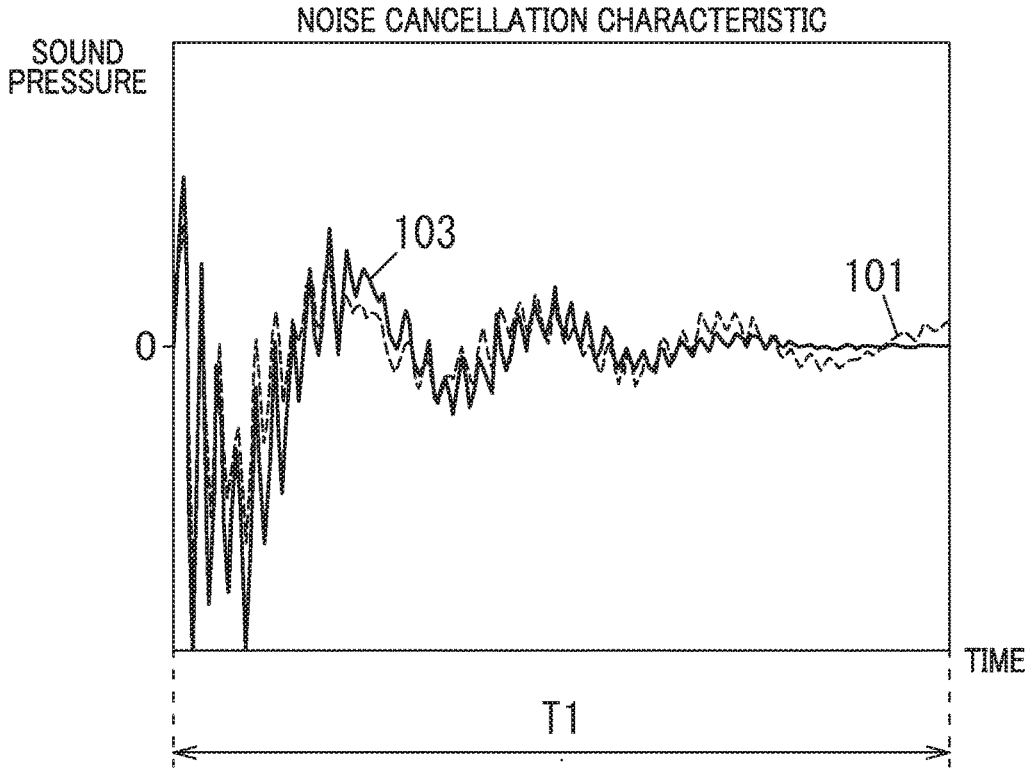
FIG. 5A is an explanatory view illustrating a time variation of the filter coefficient when the window function process is executed.

In FIG. 5A, the solid line 103 shows a noise cancellation characteristic in the time domain over the time length T1 of the window function with the window function process being executed. The window function process is executed, so that the noise cancellation characteristic in the time domain is stable without oscillation and maintains substantially the same noise cancellation amount as that in the case where the stabilization control is performed (broken line 101) without the window function process being performed.

Figure 5B:
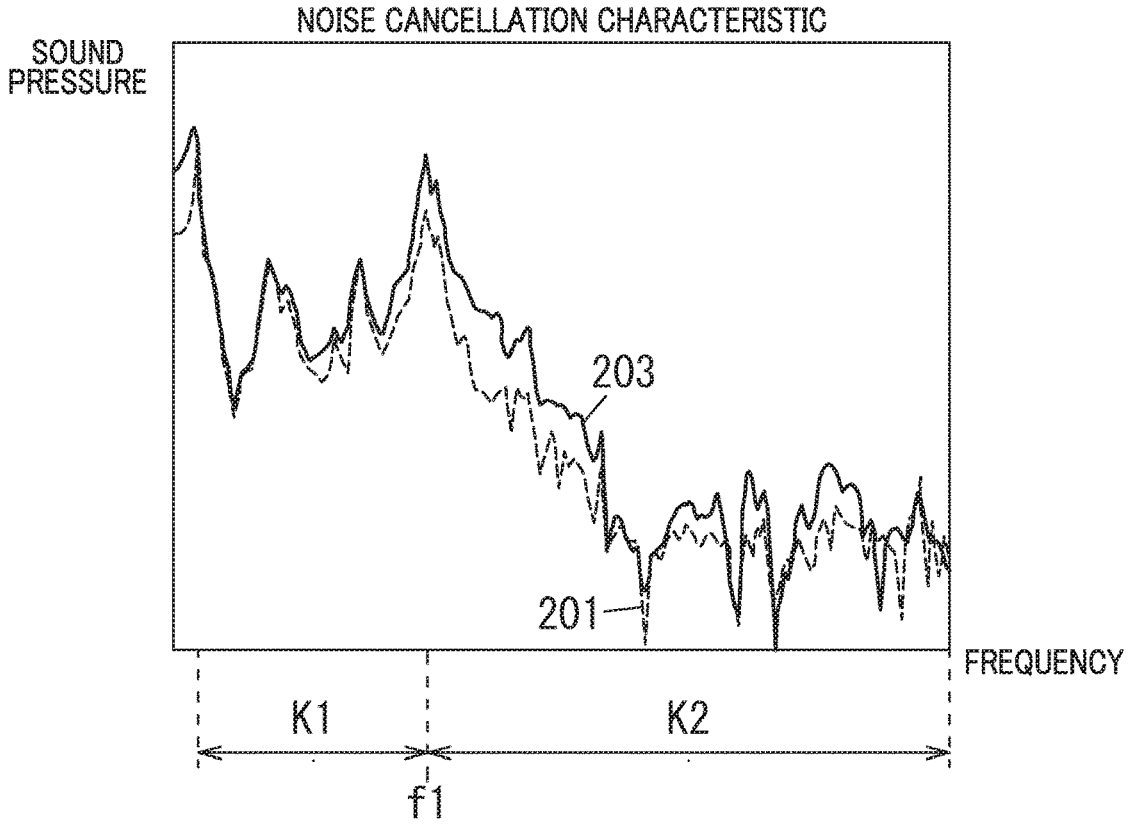
FIG. 5B is a waveform diagram illustrating a noise cancellation characteristic when the window function process is executed.

In FIG. 5B, the solid line 203 shows a noise cancellation characteristic in the frequency domain with the window function process being executed. The window function process is executed, so that the noise cancellation characteristic in the frequency domain maintains substantially the same noise cancellation amount as that in the case where the stabilization control is performed (broken line 201) without the window function process being performed. In particular, it can be seen that in the target band K1 which will be a noise cancellation target, the influence of the execution of the window function process is small, and there is no practical problem. Moreover, also in the non-target band K2, the degradation of the noise cancellation performance is suppressed.

Thus, the above-described signal processing device 12 suppresses oscillation caused due to a change of environmental conditions such as the temperature, humidity, and atmospheric pressure of the space in the duct 21 and/or a disturbance component such as an intruding extraneous sound, thereby enabling suppression of the degradation in the noise cancellation performance.

Second Embodiment

Figure 6:
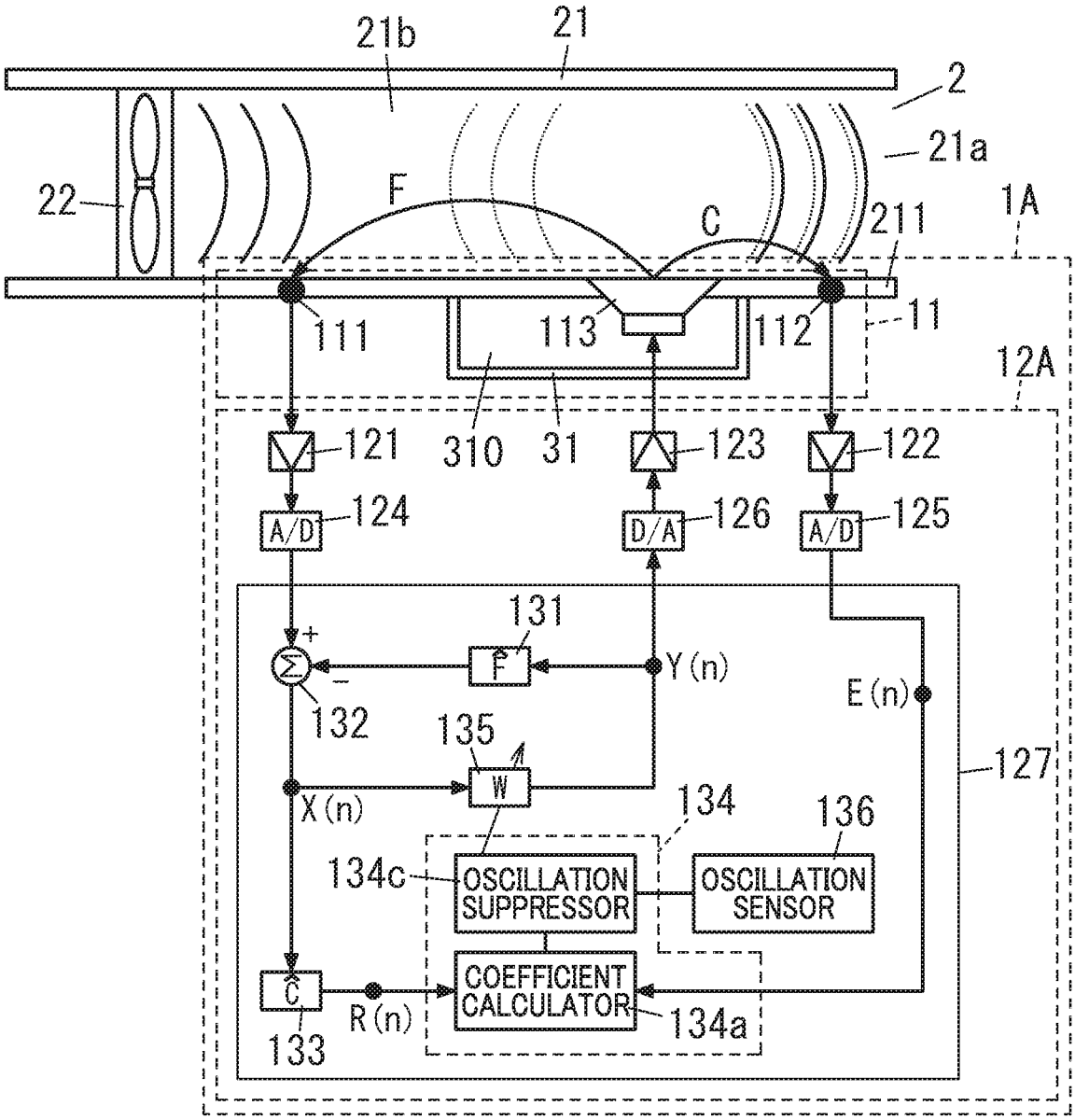
FIG. 6 is a block diagram illustrating a configuration of a rangehood apparatus of a second embodiment.

FIG. 6 shows the configuration of a noise cancelling device 1A of the present embodiment. The noise cancelling device 1A includes a signal processing device 12A. The second embodiment is different from the first embodiment in that a coefficient updating unit 134 includes an oscillation suppressor 134*c* instead of the oscillation suppressor 134*b* and a noise cancellation control block 127 includes an oscillation sensor 136. Components similar to those of the first embodiment are hereinafter denoted by the same reference signs as those in the first embodiment, and the description thereof will be omitted.

The oscillation suppressor 134*c* is capable of switching between two patterns of operation of setting the filter coefficient W of a sound cancelling filter 135. In first operation, the oscillation suppressor 134*c* can set a filter coefficient W1(*n*) without a window function process being performed as the filter coefficient W of the sound cancelling filter 135 (filter coefficient W=W1(*n*)). In second operation, the oscillation suppressor 134*c* can set a filter coefficient W2(*n*) with the window function process being performed as the filter coefficient W of the sound cancelling filter 135 (filter coefficient W=W2(*n*)).

Moreover, the oscillation sensor 136 can detect oscillation. The amplitude of each of the cancelling sound, reference signal, and error signal at the time of the oscillation is larger than that in the case where the stabilization control is performed. Thus, the oscillation sensor 136 determines at least one of an input to a loudspeaker 113, an output of a reference microphone 111, and an output of an error microphone 112 as a monitoring target. When the amplitude of the monitoring target is greater than or equal to the threshold, the oscillation sensor 136 can detect the oscillation. Moreover, an oscillation band can generally be investigated in advance. Examples of the oscillation band is a notch band of a transfer characteristic C. Thus, the oscillation sensor 136 may detect oscillation when in the oscillation band, the amplitude of the monitoring target is greater than or equal to the threshold.

The oscillation suppressor 134*c* switches the operation of setting the filter coefficient W of the sound cancelling filter 135 to the first operation or the second operation on the basis of a result of the detection by the oscillation sensor 136.

In general, the oscillation suppressor 134*c* sets the operation of setting the filter coefficient W of the sound cancelling filter 135 to the first operation. That is, the sound cancelling filter 135 operates with the filter coefficient W=W1(*n*) without the window function process being executed.

Then, when the oscillation sensor 136 detects oscillation, the oscillation suppressor 134*c* switches the operation of setting the filter coefficient W of the sound cancelling filter 135 to the second operation. That is, the sound cancelling filter 135 operates with the filter coefficient W=W2(*n*) with the window function process being executed. Thus, the operation of the sound cancelling filter 135 with the filter coefficient W=W2(*n*) suppresses the oscillation.

When the oscillation is suppressed, and the oscillation sensor 136 no longer detects the oscillation, the oscillation suppressor 134*c* switches the operation of setting the filter coefficient W of the sound cancelling filter 135 to the first operation.

Thus, the sound cancelling filter 135 generally operates with the filter coefficient W=W1(*n*) without the window function process being executed and can thus realize a noise cancellation characteristic similar to the conventional noise cancellation characteristic. Moreover, when oscillation is detected, the sound cancelling filter 135 operates with the filter coefficient W=W2(*n*) with the window function process being executed, and thus the oscillation is suppressed.

Third Embodiment

Figure 7:
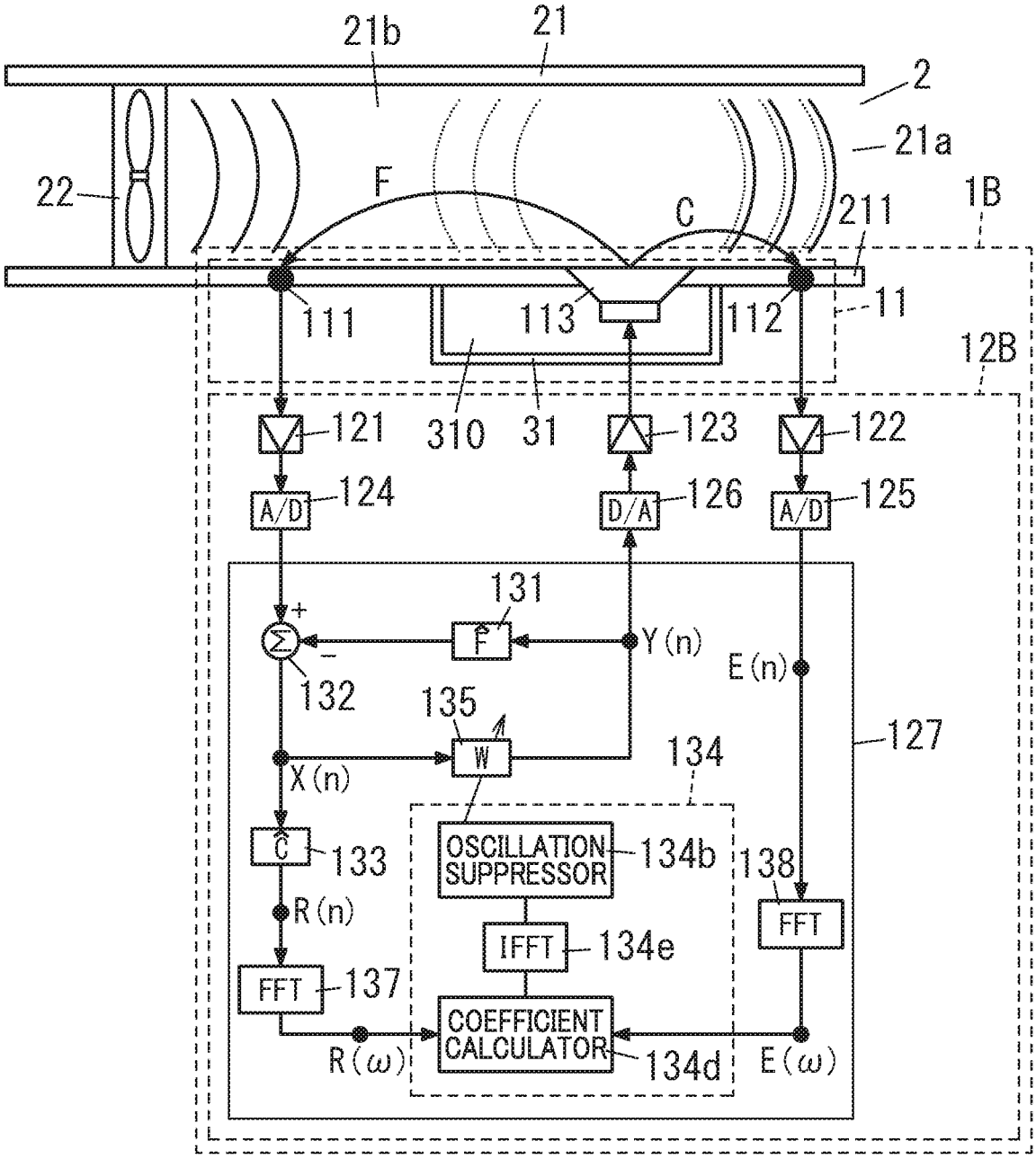
FIG. 7 is a block diagram illustrating a configuration of a rangehood apparatus of a third embodiment.

FIG. 7 shows the configuration of a noise cancelling device 1B of the present embodiment. The noise cancelling device 1B includes a signal processing device 12B. The third embodiment is different from the first embodiment in that the signal processing device 12B further includes converters 137 and 138, and a coefficient updating unit 134 includes an oscillation suppressor 134*b*, a coefficient calculator 134*d*, and an inverse converter 134*e*. That is, the noise cancelling device 1B is different from that of the first embodiment in that a filtered-X LMS in a frequency domain is used. Components similar to those of the first embodiment are hereinafter denoted by the same reference signs as those in the first embodiment, and the description thereof will be omitted.

First, a sound cancelling filter 135 has a configuration in which a filter coefficient W1(*n*) is set for each of a plurality of frequency bins obtained by dividing the entire frequency band of a cancelling sound.

A converter 137 converts a reference signal R(n) in a time domain into a reference signal R(ω) in the frequency domain with Fast Fourier Transform (FFT) to output the reference signal R(ω) to the coefficient updating unit 134. The converter 138 converts an error signal E(n) in the time domain into an error signal E(ω) in the frequency domain with the FFT to output the error signal E(ω) to the coefficient updating unit 134. Note that ω(rad/sec) is the angular frequency of a signal. When the frequency of a signal is f(Hz), $\omega=2\pi f$.

The coefficient calculator 134*d* of the coefficient updating unit 134 uses a known sequential update control algorithm, filtered-X LMS, in the frequency domain to calculate a filter coefficient W1(ω) (first filter coefficient) in the frequency domain. The coefficient calculator 134*d* receives the reference signal R(ω) and the error signal E(ω) and computes the filter coefficient W1(ω).

Specifically, the coefficient calculator 134*d* calculates the filter coefficient W1(ω) for each frequency bin. In an update processing of the filter coefficient W1(ω) using the filtered-X LMS, the filter coefficient W1(ω) is calculated such that the error signal E(ω) is minimum.

The inverse converter 134*e* executes Inverse Fast Fourier Transform (inverse FFT) to convert the filter coefficient W1(ω) in the frequency domain for each frequency bin into a filter coefficient W1(*n*) in the time domain for each frequency bin.

Each time the inverse converter 134*e* updates the filter coefficient W1(*n*) in the time domain, the oscillation suppressor 134*b* multiplies the filter coefficient W1(*n*) by a window function H(n) shown in FIG. 3.

The oscillation suppressor 134*b* multiplies the filter coefficient W1(*n*) of each frequency bin by the window function H(n) to determine a filter coefficient W2(*n*) (second filter coefficient) for each frequency bin. The gain of the filter coefficient W2(*n*) is less than or equal to the gain of the filter coefficient W1(*n*) calculated by the coefficient calculator 134*a*, and as time passes, the difference between the gain of the filter coefficient W2(*n*) and the gain of the filter coefficient W1(*n*) becomes large. The oscillation suppressor 134*b* sets the filter coefficient W2(*n*) as the filter coefficient W of the sound cancelling filter 135 (filter coefficient W=W2(*n*)) to update the filter coefficient W of the sound cancelling filter 135 for each frequency bin. That is, a process of multiplication by the window function H(n) is repeated each time the filter coefficient W is updated, and the gain of the filter coefficient W(=W2(*n*)) decreases as time passes after the update.

The sound cancelling filter 135 divides a noise signal X(n) for each frequency bin and performs convolution of the noise signal X(n) and the filter coefficient W(=W2(*n*)) for each frequency bin. Then, the sound cancelling filter 135 outputs the sum of results of the convolution performed for the frequency bins as a cancellation signal Y(n). The cancellation signal Y(n) is subjected to D/A conversion in a D/A converter 126 and is then amplified in an amplifier 123 to output a cancelling sound from a loudspeaker 113.

As described above, the coefficient calculator 134*d* preferably performs arithmetic processing of the filter coefficient W1 in the frequency domain.

Figure 8A:
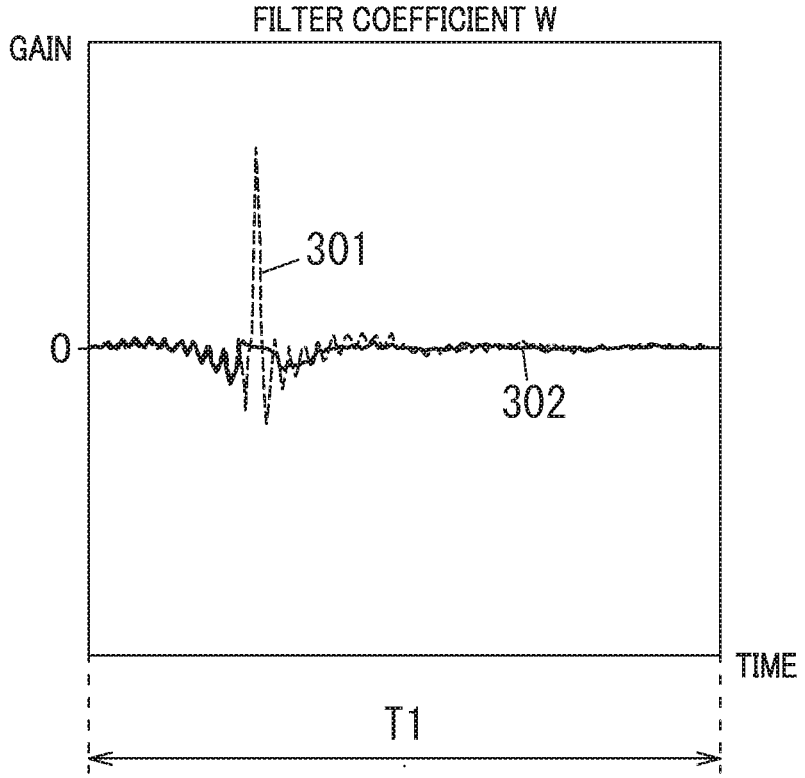
FIG. 8A is an explanatory view illustrating a time variation of the filter coefficient when a filtered-X LMS in a frequency domain is used.

For example, when the oscillation suppressor 134*b* of the present embodiment does not execute the window function process, and the filter coefficient W1(*n*) is set as the filter coefficient W of the sound cancelling filter 135, a time variation of the filter coefficient W=W1(*n*) is a variation as shown by the broken line 301 in FIG. 8A. When the oscillation suppressor 134*b* executes the window function process, and the filter coefficient W2(*n*) is set as the filter coefficient W of the sound cancelling filter 135, the time variation of the filter coefficient W=W2(*n*) is a variation as shown by the solid line 302 in FIG. 8A.

Figure 8B:
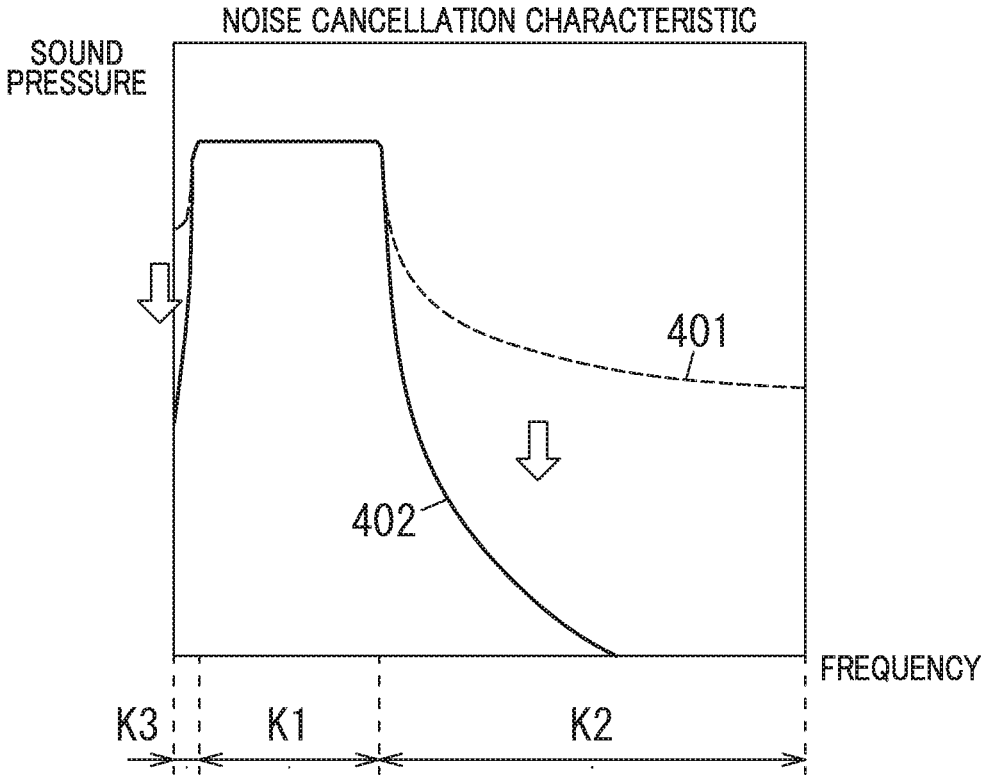
FIG. 8B is a waveform diagram illustrating a noise cancellation characteristic when the filtered-X LMS in the frequency domain is used.

When the window function process is not executed, the noise cancellation characteristic is a characteristic as shown by the broken line 401 in FIG. 8B. When the window function process is executed, the noise cancellation characteristic is a characteristic as shown by the solid line 402 in the FIG. 8B.

When the window function process is not executed in the case of using the filtered-X LMS in the frequency domain, components of a non-target band K2 higher than a target band K1 and a non-target band K3 lower than the target band K1 are amplified as indicted by the broken line 401 in FIG. 8B. However, executing the window function process suppresses the components of the non-target bands K2 and K3, which improves the noise cancellation performance of the noise cancelling device 1B.

Fourth Embodiment

Figure 9:
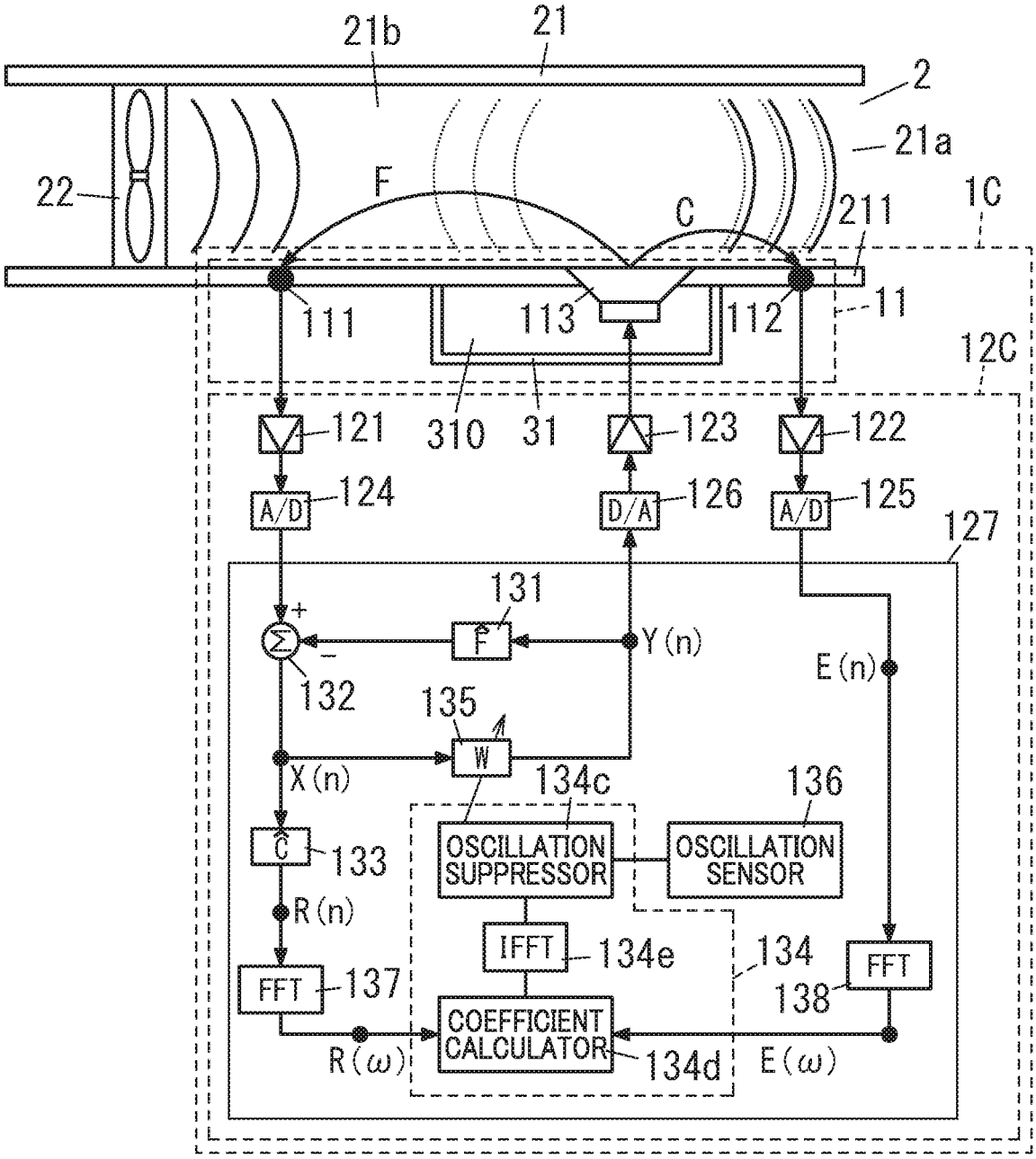
FIG. 9 is a block diagram illustrating a configuration of a rangehood apparatus of a fourth embodiment.

FIG. 9 shows the configuration of a noise cancelling device 1C of the present embodiment. The noise cancelling device 1C includes a signal processing device 12C. The fourth embodiment is different from the third embodiment in that a coefficient updating unit 134 includes an oscillation suppressor 134*c* instead of the oscillation suppressor 134*b* and a noise cancellation control block 127 includes an oscillation sensor 136. Note that the oscillation suppressor 134*c* is a component similar to that in the second embodiment. Components similar to those in the second and third embodiments are hereinafter denoted by the same reference signs as those of the second and third embodiment, and the description thereof will be omitted.

The oscillation suppressor 134*c* switches operation of setting a filter coefficient W of a sound cancelling filter 135 to first operation or second operation on the basis of a result of detection by an oscillation sensor 136.

In general, the oscillation suppressor 134*c* sets the operation of setting the filter coefficient W of the sound cancelling filter 135 to the first operation. That is, the sound cancelling filter 135 operates with the filter coefficient W=W1(*n*) without the window function process being executed.

Then, when the oscillation sensor 136 detects oscillation, the oscillation suppressor 134*c* switches the operation of setting the filter coefficient W of the sound cancelling filter 135 to the second operation. That is, the sound cancelling filter 135 operates with the filter coefficient W=W2(*n*) with the window function process being executed. Thus, the operation of the sound cancelling filter 135 with the filter coefficient W=W2(*n*) suppresses the oscillation.

When the oscillation is suppressed, and the oscillation sensor 136 no longer detects the oscillation, the oscillation suppressor 134*c* switches the operation of setting the filter coefficient W of the sound cancelling filter 135 to the first operation.

Thus, the sound cancelling filter 135 generally operates with the filter coefficient W=W1(*n*) without the window function process being executed and can thus realize a noise cancellation characteristic similar to the conventional noise cancellation characteristic. Moreover, when oscillation is detected, the sound cancelling filter 135 operates with the filter coefficient W=W2(*n*) with the window function process being executed, and thus the oscillation is suppressed.

As can be clearly seen from the above-described embodiments, each of signal processing devices 12, 12A, 12B, and 12C according to a first aspect of the present invention is to be used in combination with a sound input/output device 11 including a reference microphone 111 (first sound input device), a loudspeaker 113 (sound output device), and an error microphone 112 (second sound input device). The reference microphone 111 is disposed in a target space (space in a duct 21) in which noise generated from a fan 22 (noise source) propagates. The reference microphone 111 is configured to collect the noise. The loudspeaker 113 is configured to receive a cancellation signal to output a cancelling sound for cancelling the noise to the target space. The error microphone 112 is configured to collect a synthetic sound of the noise and the cancelling sound in the target space.

Each of the signal processing devices 12, 12A, 12B, and 12C includes a sound cancelling filter 135, the coefficient calculator 134*a* or 134*d*, and the oscillation suppressor 134*b* or 134*c*. A filter coefficient W is set in the sound cancelling filter 135, and the sound cancelling filter 135 is configured to output a cancellation signal Y(n) based on an output of the reference microphone 111. Each of the coefficient calculators 134*a* and 134*d* is configured to calculate a filter coefficient W1(*n*) (first filter coefficient) based on the output of the reference microphone 111 and an output of the error microphone 112. Each of the oscillation suppressors 134*b* and 134*c* is configured to calculate a filter coefficient W2(*n*) (second filter coefficient) by applying a window function H(n) for suppressing oscillation to the filter coefficient W1(*n*). Each of the oscillation suppressors 134*b* and 134*c* is configured to set the filter coefficient W2(*n*) as the filter coefficient W of the sound cancelling filter 135.

That is, according to the signal processing device according to the first aspect, each of the signal processing devices 12, 12A, 12B, and 12C multiplies the filter coefficient W1(*n*) based on the output of the reference microphone 111 and the output of the error microphone 112 by a window function H(n) to calculate the filter coefficient W2(*n*). Then, each of the signal processing devices 12, 12A, 12B, and 12C sets the filter coefficient W2(*n*) as the filter coefficient W of the sound cancelling filter 135. Thus, it is possible to prevent continuation of a positive feedback state of a signal at a feedback ratio of greater than or equal to 1 in a feedback path of the loudspeaker 113—the reference microphone 111—the signal processing device 12, 12A, 12B, 12C—the loudspeaker 113, thereby suppressing oscillation. Moreover, it is also possible to prevent continuation of a positive feedback state of a signal at a feedback ratio of greater than or equal to 1 in a feedback path of the loudspeaker 113—the error microphone 112—the signal processing device 12, 12A, 12B, 12C—the loudspeaker 113, thereby suppressing the oscillation.

Thus, each of the above-described signal processing devices 12, 12A, 12B, and 12C suppresses the oscillation caused due to a change of environmental conditions such as the temperature, humidity, and atmospheric pressure of the space in the duct 21 and/or a disturbance component such as an intruding extraneous sound, thereby enabling suppression of degradation in a noise cancellation performance.

Note that the oscillation means a phenomenon that the amplitude of a specific frequency of a sound propagating in the duct 21 becomes larger than that before noise cancellation control, and the noise cancellation performance is thereby degraded. On the other hand, the divergence means a state where excessive amplification of the specific frequency of the sound propagating in the duct 21 significantly degrades the characteristic of the sound cancelling filter 135, and an abnormal cancelling sound is thereby output.

In each of the signal processing devices 12, 12A, 12B, and 12C according to a second aspect of the present invention with reference to the first aspect, the window function H(n) preferably has a characteristic that a window function value decreases as time passes (see FIG. 3).

According to the second aspect, the gain of the filter coefficient W(=W2(*n*)) decreases as time passes after the update of the filter coefficient W. Thus, the oscillation can be more reliably suppressed.

In a signal processing device 12B or 12C according to a third aspect of the present invention referring to the first or second aspect, the coefficient calculator 134*d* preferably performs arithmetic processing of the filter coefficient W1 in a frequency domain.

According to the third aspect, a computation amount in the calculation process of the filter coefficient in the frequency domain is smaller than that in the calculation process of the filter coefficient in the time domain. Therefore, the filter coefficient W1 can be obtained with a relatively small computation amount.

In the signal processing device 12A or 12C according to a fourth aspect according to the present invention referring to any one of the first to third aspect, the oscillation suppressor 134*c* is capable of switching between first operation and second operation. In the first operation, the oscillation suppressor 134*c* sets the filter coefficient W1(*n*) as the filter coefficient W of the sound cancelling filter 135. In the second operation, the oscillation suppressor 134*c* sets the filter coefficient W2(*n*) as the filter coefficient W of the sound cancelling filter 135. The signal processing device 12A further includes an oscillation sensor 136 configured to detect the oscillation. It is preferable that the oscillation suppressor 134*c* perform the first operation when the oscillation is not detected whereas the oscillation suppressor 134*c* perform the second operation when the oscillation is detected.

According to the fourth aspect, since the sound cancelling filter 135 generally operates with the filter coefficient W=W1(*n*) without the window function process being executed, a noise cancellation characteristic which is the same as a conventional noise cancellation characteristic can be realized. Moreover, when the oscillation is detected, the sound cancelling filter 135 operates with the filter coefficient W=W2(*n*) with the window function process being executed, and thus the oscillation is suppressed.

A signal processing method according to a fifth aspect of the present invention is to be used in a signal processing device 12 which is to be combined with a sound input/output device 11 including a reference microphone 111 (first sound input device), a loudspeaker 113 (sound output device), and an error microphone 112 (second sound input device). The reference microphone 111 is disposed in a target space (a space in a duct 21) in which noise generated from a fan 22 (noise source) propagates. The reference microphone 111 is configured to collect the noise. The loudspeaker 113 is configured to receive a cancellation signal to output a cancelling sound for cancelling the noise to the target space. The error microphone 112 is configured to collect a synthetic sound of the noise and the cancelling sound in the target space.

In a sound cancelling filter 135, a filter coefficient W is set, and the sound cancelling filter 135 outputs a cancellation signal Y(n) based on an output of the reference microphone 111. A coefficient calculator 134*a*, 134*d* calculates a filter coefficient W1(*n*) (first filter coefficient) on the basis of the output of the reference microphone 111 and an output of the error microphone 112. An oscillation suppressor 134*b*, 134*c* of the signal processing device 12, 12A, 12B, 12C calculates a filter coefficient W2(*n*) (second filter coefficient) by applying a window function H(n) for suppressing oscillation to the filter coefficient W1(*n*). The oscillation suppressor 134*b*, 134*c* sets the filter coefficient W2(*n*) as the filter coefficient W of the sound cancelling filter 135.

Thus, the above-described signal processing method also suppresses the oscillation caused due to a change of environmental conditions such as the temperature, humidity, and atmospheric pressure of the space in the duct 21 and/or a disturbance component such as an intruding extraneous sound, thereby enabling suppression of the degradation in a noise cancellation performance.

Each of the signal processing devices 12, 12A, 12B, and 12C in the above-described embodiments is provided with a computer, and the computer executes a program to realize the function of the noise cancellation control block 127. The computer includes a device including a processor configured to execute the program, a device for interface for transmitting and receiving data to and from another device, and a device for storing data as main components. The device including the processor may be a micro processing unit (MPU) which is separated from the semiconductor memory or may be a micro controller integrally including a semiconductor memory. As the device for storage, both a storage device such as a semiconductor memory having short access time and a large-capacitance storage device such as a hard disk device are used in combination.

The program may be provided in a state where the program is stored in advance in a recording medium such as a computer-readable read-only memory (ROM) or an optical disk or a state where the program is supplied to the recording medium via a wide-area communication network including the Internet.

That is, a program according to a sixth aspect of the present invention causes a computer to function as the signal processing device according to any one of the first to fourth aspect.

Thus, the program which causes the computer to function as the signal processing device 12, 12A, 12B, 12C can provide effects similar to those described above. That is, this program also suppresses the oscillation caused due to a change of environmental conditions such as the temperature, humidity, and atmospheric pressure of the space in the duct 21 and/or a disturbance component such as an intruding extraneous sound, thereby enabling suppression of the degradation in the noise cancellation performance.

A rangehood apparatus 2 according to a seventh aspect of the present invention includes the signal processing device according to any one of the first to fourth aspects, a sound input/output device 11, an air passage (a space in a duct 21) having a hollow cylindrical shape and included in the target space, and an air blowing device (fan 22) configured to generate airflow from one end toward the other end of the air passage.

Thus, the above-described rangehood apparatus 2 can also provide effects similar to those described above. That is, this program also suppresses the oscillation caused due to a change of environmental conditions such as the temperature, humidity, and atmospheric pressure of the space in the duct 21 and/or a disturbance component such as an intruding extraneous sound, thereby enabling suppression of the degradation in the noise cancellation performance.

Note that the above-described embodiments are mere examples of the present invention. Thus, the present invention is not limited to the above-described embodiments, embodiments other than the above-described embodiments may be modified depending on design and the like without departing from the technical scope of the present invention.

REFERENCE SIGNS LIST

1, 1A, 1B, 1C Noise Cancelling Device
11 Sound Input/Output Device
12, 12A, 12B, 12C Signal Processing Device
111 Reference Microphone (First Sound Input Device)
112 Error Microphone (Second Sound Input Device)
113 Loudspeaker (Sound Output Device)
127 Noise Cancellation Control Block
131 Howling Cancel Filter
132 Subtractor
133 Correction Filter
134 Coefficient Updating Unit
134*a*, 134*d* Coefficient Calculator
134*b*, 134*c* Oscillation suppressor
134*e* Inverse Converter
135 Sound Cancelling Filter
136 Oscillation Sensor
137, 138 Converter
2 Rangehood Apparatus
21 Duct (Air Passage)
22 Fan (Ventilation Device)

The invention claimed is:

1. A signal processing device to be used in combination with a sound input/output device, the sound input/output device including a first sound input device disposed in a target space in which noise generated from a noise source propagates, the first sound input device being configured to collect the noise, a sound output device configured to receive a cancellation signal to output a cancelling sound for cancelling the noise to the target space, and a second sound input device configured to collect a resultant sound of the noise and the cancelling sound in the target space, the signal processing device comprising:

a sound cancelling filter in which a filter coefficient is set, the sound cancelling filter being configured to output the cancellation signal based on an output of the first sound input device;

a coefficient calculator configured to calculate a first filter coefficient based on the output of the first sound input device and an output of the second sound input device; and an oscillation suppressor configured to calculate a second filter coefficient by applying, to the first filter coefficient, a window function for suppressing an oscillation of a noise cancellation characteristic and to set the second filter coefficient as the filter coefficient of the sound cancelling filter, wherein the window function has a characteristic that a window function value decreases as time passes.

2. The signal processing device according to claim 1, wherein the coefficient calculator performs arithmetic processing of the first filter coefficient in a frequency domain.

3. The signal processing device according to claim 2, wherein the oscillation suppressor is capable of switching between a first operation for setting the first filter coefficient as the filter coefficient of the sound cancelling filter and a second operation for setting the second filter coefficient as the filter coefficient of the sound cancelling filter, the signal processing device further includes an oscillation sensor configured to detect the oscillation of the noise cancellation characteristic, and the oscillation suppressor performs the first operation when the oscillation of the noise cancellation characteristic is not detected, whereas the oscillation suppressor performs the second operation when the oscillation of the noise cancellation characteristic is detected.

4. The signal processing device according to claim 1, wherein the oscillation suppressor is capable of switching between a first operation for setting the first filter coefficient as the filter coefficient of the sound cancelling filter and a second operation for setting the second filter coefficient as the filter coefficient of the sound cancelling filter, the signal processing device further includes an oscillation sensor configured to detect the oscillation of the noise cancellation characteristic, and the oscillation suppressor performs the first operation when the oscillation of the noise cancellation characteristic is not detected, whereas the oscillation suppressor performs the second operation when the oscillation of the noise cancellation characteristic is detected.

5. A rangehood apparatus, comprising:

the signal processing device according to claim 1;

the sound input/output device;

an air passage having a hollow cylindrical shape and included in the target space; and an air blowing device configured to generate airflow from a first end toward a second end of the air passage.

6. A rangehood apparatus, comprising:

the signal processing device according to claim 2;

the sound input/output device;

an air passage having a hollow cylindrical shape and included in the target space; and an air blowing device configured to generate airflow from a first end toward a second end of the air passage.

7. A rangehood apparatus, comprising:

the signal processing device according to claim 4;

the sound input/output device;

an air passage having a hollow cylindrical shape and included in the target space; and an air blowing device configured to generate airflow from a first end toward a second end of the air passage.

8. A computer-readable, non-transitory, and tangible recording medium recording a program to be stored in a computer, the program causing the computer to function as the signal processing device according to claim 1.

9. A computer-readable, non-transitory, and tangible recording medium recording a program to be stored in a computer, the program causing the computer to function as the signal processing device according to claim 2.

10. A computer-readable, non-transitory, and tangible recording medium recording a program to be stored in a computer, the program causing the computer to function as the signal processing device according to claim 4.

11. A signal processing method to be used in a signal processing device which is to be combined with a sound input/output device, the sound input/output device including a first sound input device disposed in a target space in which noise generated from a noise source propagates, the first sound input device being configured to collect the noise, a sound output device configured to receive a cancellation signal to output a cancelling sound for cancelling the noise to the target space, and a second sound input device configured to collect a resultant sound of the noise and the cancelling sound in the target space, the signal processing method comprising:

outputting the cancellation signal from a sound cancelling filter in which a filter coefficient is set, the cancellation signal being based on an output of the first sound input device;

calculating a first filter coefficient by a coefficient calculator based on an output of the first sound input device and an output of the second sound input device; and calculating a second filter coefficient by applying, to the first filter coefficient, a window function for suppressing an oscillation of a noise cancellation characteristic by an oscillation suppressor to set the second filter coefficient as the filter coefficient of the sound cancelling filter, wherein the window function has a characteristic that a window function value decreases as time passes.

12. A signal processing device to be used in combination with a sound input/output device, the sound input/output device including a first sound input device disposed in a target space in which noise generated from a noise source propagates, the first sound input device being configured to collect the noise, a sound output device configured to receive a cancellation signal to output a cancelling sound for cancelling the noise to the target space, and a second sound input device configured to collect a resultant sound of the noise and the cancelling sound in the target space, the signal processing device comprising:

a sound cancelling filter in which a filter coefficient is set, the sound cancelling filter being configured to output the cancellation signal based on an output of the first sound input device;

a coefficient calculator configured to calculate a first filter coefficient based on the output of the first sound input device and an output of the second sound input device; and an oscillation suppressor configured to calculate a second filter coefficient by applying, to the first filter coefficient, a window function for suppressing an oscillation of a noise cancellation characteristic, wherein the oscillation suppressor is capable of switching between a first operation for setting the first filter coefficient as the filter coefficient of the sound cancelling filter and a second operation for setting the second filter coefficient as the filter coefficient of the sound cancelling filter, the signal processing device further includes an oscillation sensor configured to detect the oscillation of the noise cancellation characteristic, and the oscillation suppressor performs the first operation when the oscillation of the noise cancellation characteristic is not detected, whereas the oscillation suppressor performs the second operation when the oscillation of the noise cancellation characteristic is detected.

* * * * *